United States Patent [19]

Kinoshita et al.

[11] 4,396,516

[45] Aug. 2, 1983

[54] LUBRICANT

[75] Inventors: Hirotsugu Kinoshita, Kawasaki; Hiroshi Uemura, Machida; Makoto Sekiya, Kawasaki; Kazuyoshi Mitamura, Yokohama, all of Japan

[73] Assignee: Nippon Oil Company, Ltd., Japan

[21] Appl. No.: 261,155

[22] PCT Filed: Oct. 7, 1980

[86] PCT No.: PCT/JP80/00239

§ 371 Date: Jun. 9, 1981

§ 102(e) Date: Apr. 16, 1981

[87] PCT Pub. No.: WO81/01011

PCT Pub. Date: Apr. 16, 1981

[30] Foreign Application Priority Data

Oct. 9, 1979 [JP] Japan ..... 54-129500

[51] Int. Cl.[3] ..... C10M 1/20; C10M 1/32; C10M 1/34

[52] U.S. Cl. ..... 252/51.5 A; 546/243; 548/476; 548/545; 548/548

[58] Field of Search ..... 252/51.5 A; 260/326.5 F, 326.5 FM; 546/243; 548/476, 545, 548

[56] References Cited

U.S. PATENT DOCUMENTS

| | | | |
|---|---|---|---|
| 2,594,286 | 4/1952 | Bryant et al. | 252/51.5 A |
| 2,669,555 | 2/1954 | Giammaria | 260/326.5 FM |
| 3,219,666 | 11/1965 | Norman et al. | 252/51.5 A |

FOREIGN PATENT DOCUMENTS

| | | | |
|---|---|---|---|
| 518472 | 11/1955 | Canada | 548/548 |
| 961434 | 6/1964 | United Kingdom | 548/548 |

*Primary Examiner*—W. J. Shine

*Attorney, Agent, or Firm*—McGlew and Tuttle

[57] ABSTRACT

This invention is a lubricant comprising an imide compound obtained by reacting a dibasic acid selected from the group consisting of succinic acid, maleic acid, glutaric acid and phthalic acid with a primary amine having a $C_8$–$C_{18}$ hydrocarbon radical.

The lubricant of the invention may be used in combination with a specified diamine derivative and known lubricant additives, and exhibits excellent lubricating properties.

3 Claims, 3 Drawing Figures

LUBRICANT

FIELD OF TECHNOLOGY

This invention relates to a lubricant for use in sliding surfaces of non-ferrous materials, particularly non-ferrous metals such as aluminum, lead and copper and plastic materials.

BACKGROUND TECHNOLOGY

In recent years, in order to reduce the weight or cost of parts constituting machines or devices, crystalline plastics such as polytetrafluoroethylene, polyamides, polyethylene, polypropylene, polyacetal, polycarbonate and ABS and thermosetting plastics materials such as polydiallyl phthalate starting from phenol and polymides have come into widespread use in gears, especially those used in a geared motor, etc., bearings, especially roller bearings, cables for automobile speedometers, etc. These plastic materials have superior self-lubricating properties. Their properties are modified by forming composites of these materials, and they are used as sliding members in a dry condition. In order to improve their lubricating properties such as friction and wear, hitherto there have been used lubricating oils such as mineral oil-type lubricating oils, synthetic hydrocarbon oils and ester-type synthetic lubricating oils, and various lubricating greases containing the aforesaid oils as base oils. It has been desired, however, to develop a novel lubricant having a much lower coefficient of friction than the aforesaid conventional lubricants in order to prevent friction, noise, heat generation at frictional parts, etc.

The present inventors made extensive investigations, and consequently found that an imide compound obtained as the product of reaction between a dibasic acid selected from succinic acid, maleic acid, glutaric acid and phthalic acid or the anhydride thereof and a primary amine having a hydrocarbon radical with 8 to 18 carbon atoms exhibits low frictional properties on a sliding surface between non-ferrous materials and a sliding surface between a ferrous material and a non-ferrous material.

DISCLOSURE OF THE INVENTION

This invention is based on the aforesaid discovery. It is an object of this invention to provide a lubricant having improved lubricating properties such as reducing friction and wear in a sliding surface between the aforesaid non-ferrous materials. Another object of the invention is to provide a process which can make the aforesaid lubricant available industrially at low cost.

BRIEF DESCRIPTION OF THE DRAWINGS

In FIG. 1, $\overline{X}$ and $\rho$ of the torque curves in the respective cases are as follows:

| | Static oscillating torque | Static rotating torque | Dynamic oscillating torque | Dynamic rotating torque |
|---|---|---|---|---|
| Grease F of the invention | $\overline{X} = 0.136$ $\sigma = 0.011$ | $\overline{X} = 0.135$ $\sigma = 0.012$ | $\overline{X} = 0.096$ $\sigma = 0.008$ | $\overline{X} = 0.123$ $\sigma = 0.012$ |

-continued

| | Static oscillating torque | Static rotating torque | Dynamic oscillating torque | Dynamic rotating torque |
|---|---|---|---|---|
| Commercial grease B | $\overline{X} = 0.478$ $\sigma = 0.034$ | $\overline{X} = 0.316$ $\sigma = 0.037$ | $\overline{X} = 0.144$ $\sigma = 0.015$ | $\overline{X} = 0.134$ $\sigma = 0.016$ |

Figure 2:
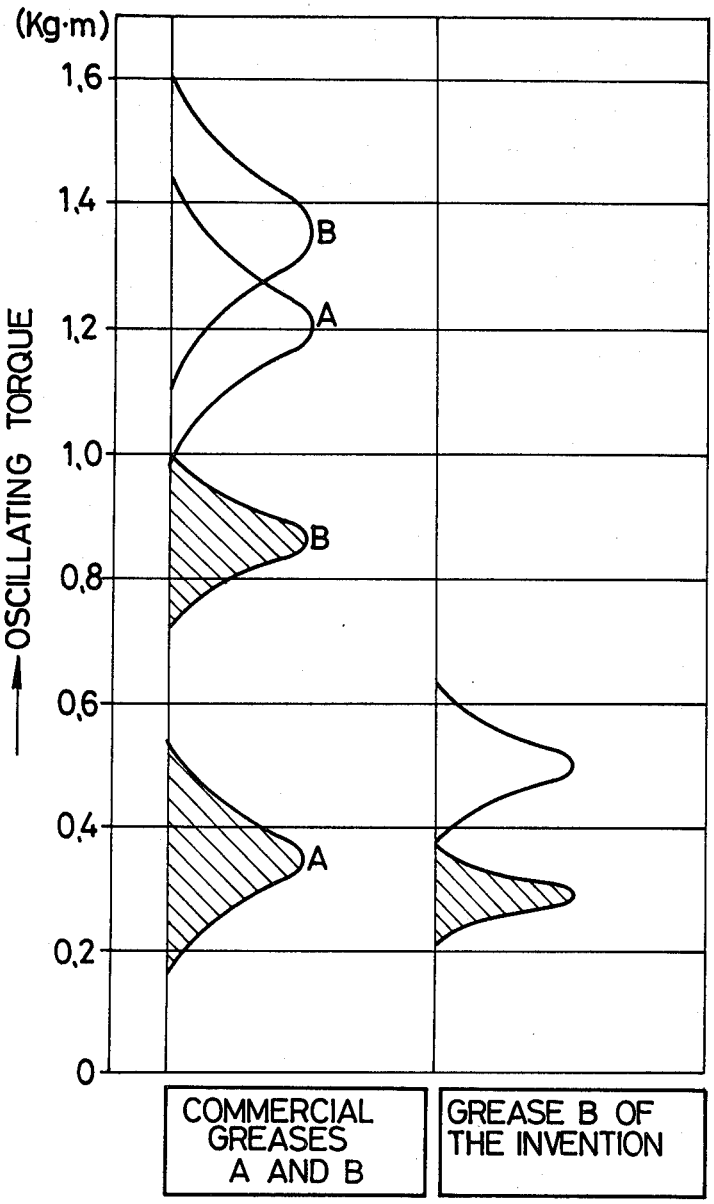

FIG. 2 shows curves of static oscillating torques and dynamic oscillating torques of ball joints 2 having sealed therein the lubricant of the invention and commercial greases A and B, respectively.

In FIG. 2, $\overline{X}$ and $\rho$ of the torque curves in the respective cases are as follows:

| | Static oscillating torque | Dynamic oscillating torque |
|---|---|---|
| Grease B of the invention | $\overline{X} = 0.503$ $\sigma = 0.043$ | $\overline{X} = 0.291$ $\sigma = 0.025$ |
| Commercial grease A | $\overline{X} = 1.217$ $\sigma = 0.076$ | $\overline{X} = 0.347$ $\sigma = 0.064$ |
| Commercial grease B | $\overline{X} = 1.355$ $\sigma = 0.082$ | $\overline{X} = 0.865$ $\sigma = 0.048$ |

Figure 1:
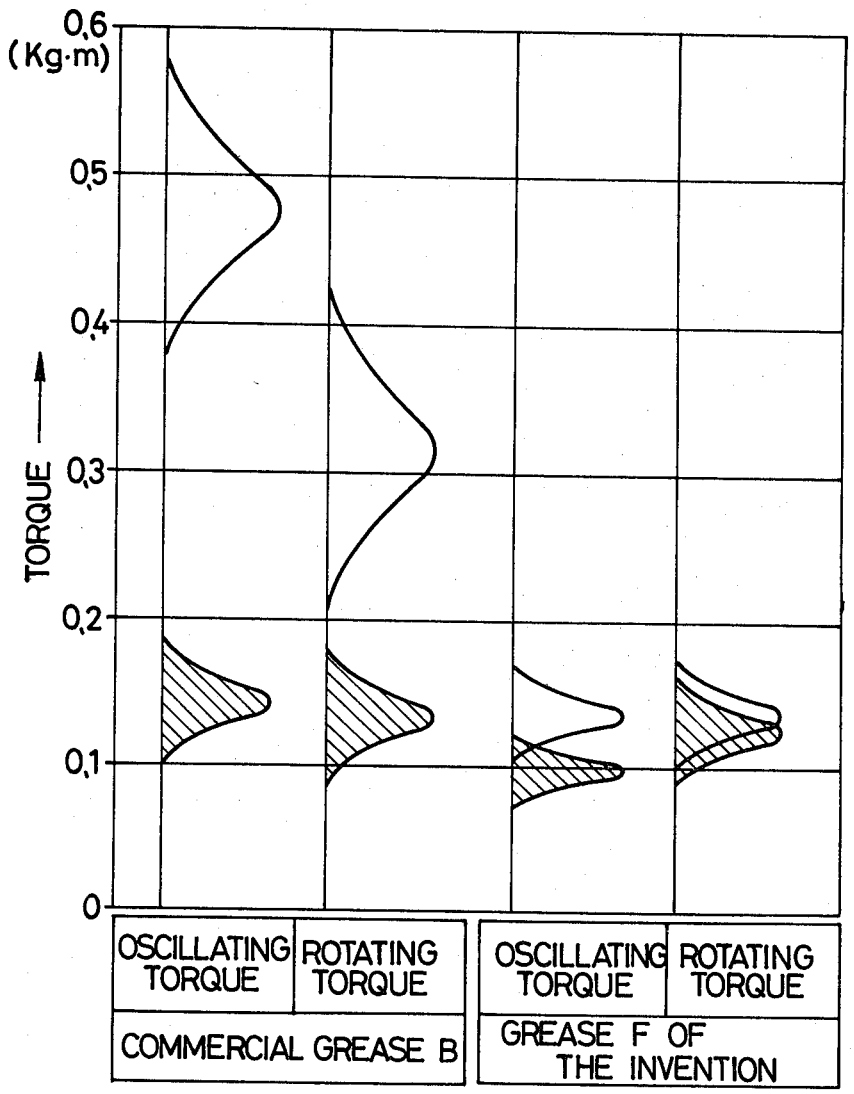
FIG. 1 attached shows curves of static torques and dynamic torques of ball joints 1 having sealed therein a lubricant F of this invention and a commercial grease B, respectively.

In FIGS. 1 and 2, the curves in the hatched areas show the dynamic torques; and the curves in the non-hatched areas, the static torques.

Figure 3:
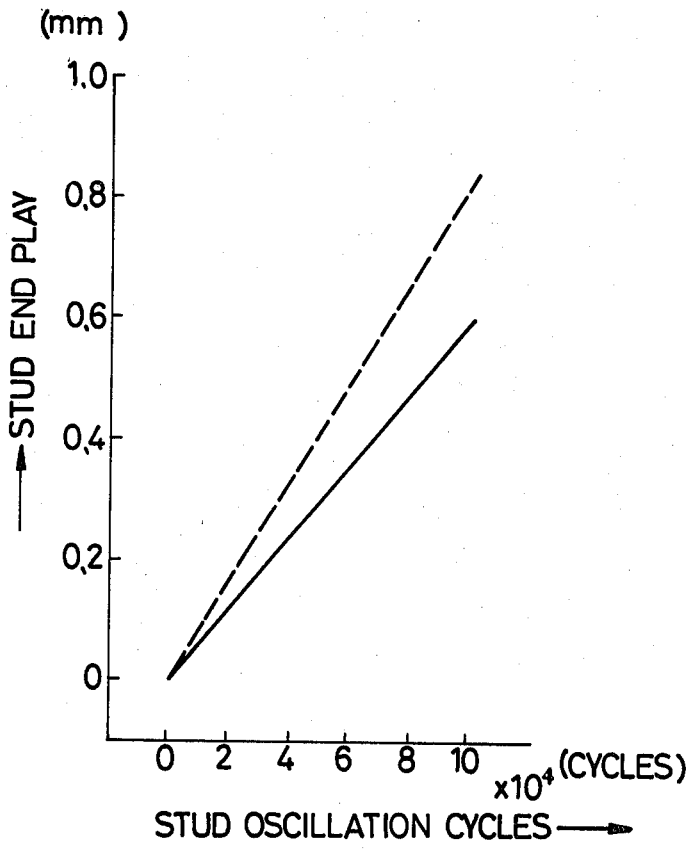

FIG. 3 is a graph showing the durability of a ball joint when lubricants C and D of the invention and a commercial Li soap grease are used.

In FIG. 3, the relations between the durability and the increase of stud end play obtained when using the lubricants C and D of the invention are on the same straight line shown by the solid line, and the relation obtained when using the commercial Li soap grease is on the straight line shown by the broken line.

BEST MODE FOR EMPLOYING THE INVENTION

The lubricant of this invention comprises an imide compound which is the product of reaction between a dibasic acid selected from succinic acid, maleic acid, glutaric acid and phthalic acid or the anhydride thereof and a primary amine having a saturated or unsaturated hydrocarbon radical with 8 to 18 carbon atoms, and may optionally contain various additives such as antioxidants, metal deactivators and rust inhibitors. When these additives are to be incorporated in the lubricating oil of this invention, the suitable amount of these is 0.1 to 3% by weight for the antioxidants, 0.01 to 0.1% by weight for the metal deactivators and 0.1 to 5% by weight for the rust inhibitors, based on the lubricant composition.

The primary amine, as referred to in this invention, denotes a saturated and/or unsaturated primary amine having a hydrocarbon radical with 8 to 18 carbon atoms. It may be a single compound or a mixture of such compounds. Preferably, oleylamine, and beef tallow amine containing it as main component are used.

The reaction between the dibasic acid and the primary mine is carried out while the mole ratio of the dibasic acid to the primary amide is adjusted to from 1:1 to 1: less than 2. The reaction conditions are atmospheric pressure and a temperature of 100° to 180° C. When the proportion of the amine is 2 moles or more per mole of the diabasic acid, the reaction product is likely to become a solid diamide, which is not suitable as a lubricant.

The reaction products obtained by heating 1 mole of the aforesaid succinic acid, maleic acid, glutaric acid and phthalic acid or the anhydrides thereof and less than 2 moles of the saturated or unsaturated primary amines with 8 to 18 carbon atoms are imide compounds represented by the following formulas, respectively.

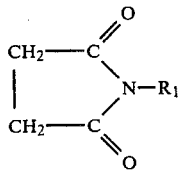
(1)

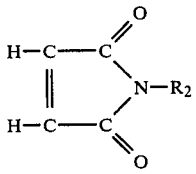
(2)

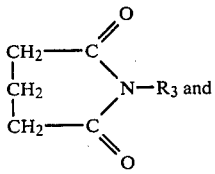
(3)

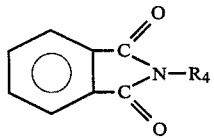
(4)

(In the above formulas, $R_1$, $R_2$, $R_3$ and $R_4$ represent a $C_8$–$C_{18}$ saturated or unsaturated hydrocarbon radical.)

These imide compounds are obtained in the form of an oil or a semi-solid grease.

As stated above, the reaction is carried out at atmospheric pressure at a temperature of 100° to 180° C. Under these conditions, an ordinary dehydrating agent such as phosphorus pentoxide ($P_2O_5$) may be used. Without using a dehydrating agent, the water formed during the reaction is removed from the reaction system by heating, and the reaction proceeds satisfactorily. If no dehydrating agent is used, impurities attributed to the use of the dehydrating agent do not get mixed with the reaction product. Accordingly, the reaction product as obtained can used advantageously and directly as a base of the lubricant composition.

According to this invention, a lubricant for ball joints can be obtained using the reaction product of maleic anhydride with beef tallow amine as a base.

To prepare the lubricant for ball joints, the maleic anhydride (A) is reacted with the beef tallow amine (B) in an (A)/(B) mole ratio in the range of $1/2 < (A)/(B) \leqq 1$, and the resulting imide compound (5) as a base is blended with a diamide compound of formula (6):

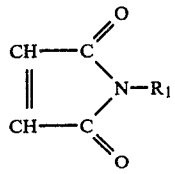
(5)

(wherein $R_1$ represents a hydrocarbon radical of the beef tallow amine)

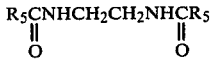
(6)

(wherein $R_5$ is a $C_{14}$–$C_{18}$ alkyl or alkenyl radical).

The imide compound of formula (5) can be synthesized by reacting maleic anhydride with beef tallow amine by a conventionally known method. Usually, the reaction is carried out at a reaction temperature of 100° to 170° C.

The torque is measured as follows: A socket is fixed in place, and a jig having a certain definite length from the center of a stud sphere is secured to a stud. The force on the jig in oscillation or rotation is measured and defined as the oscillating torque or rotating torque. The torque generated when the ball joint is oscillated or rotated for the first time while the assembly is allowed to stand is defined as the static torque, and the torque generated after pivotally rotating the stud through 5 to 10 turns is defined as the dynamic torque.

The results of measuring torque characteristics in the above ball joints 1 and 2, having sealed therein the lubricants shown in Table I below, are shown in the attached FIGS. 1 and 2.

Example of Production of the Lubricant of the Invention

Maleic anhydride (100 g) was placed into a reaction vessel, and heated and dissolved. Beef tallow amine (400 g) previously heated and dissolved was added, and while stirring the mixture was heated to 150° C. and reacted for 1 hour. The reaction product was blended with 100 g of ethylenebis-oleylamide. (The resulting product is referred to hereinbelow as lubricant A.)

Then, lubricant A was used as a base, and additives were incorporated to formulate a lubricant B in a customary manner.

Lubricant B

Phenolic antioxidant—1% by weight
Metal deactivator—0.1% by weight
Lubricant A—balance

Lubricant C

Maleic anhydride (100 g) was reacted with 267 g of beef tallow amine at 150° C. for 1 hour. To the reaction product was added 150 g of ethylenebis-oleylamide.

Lubricant D

Phenolic antioxidant—1.0% by weight
Metal deactivator—0.05% by weight
Lubricant C—balance Lubricant E Maleic anhydride (100 g) was reacted with 480 g of beef tallow amine at 170° C. for 1 hour. The resulting product is designated as lubricant E.

The lubricant of this invention is illustrated in greater detail by the following Examples.

EXAMPLES 1 AND 2

The torque characteristics of a lubricant were evaluated using ball joints made up of a steel ball stud and a plastic ball seat.

Ball joint 1

Ball stud: made of steel with a spherical head portion having a diameter of 20 mm.

Ball seat: made of polyethylene (OILES #81, a tradename for a product made by Oiles Industry Co., Ltd.)

Ball joint 2

Ball stud: made of steel with a spherical head portion having a diameter of 36 mm Ball seat: made of polyacetal (OILES #80, a tradename for a product made by Oiles Industry Co., Ltd.)

Lubricant F

Amine-type antioxidant—1.0% by weight
Metal deactivator—0.05% by weight
Rust inhibitor—3 % by weight
Lubricant E—balance The torque was measured as follows: A socket was fixed in place, and a jig having a certain definite length from the center of the stud sphere was secured to the stud. The force on the jig in oscillation or rotation was measured and defined as the oscillating torque or rotating torque. The torque generated when the ball joint was first oscillated or rotated while the measuring device was allowed to stand was defined as the static torque, and the torque generated after pivotally rotating the stud through 5 to 10 turns was defined as the dynamic torque.

The results of measuring the torque characteristics of the above ball joints 1 and 2, having sealed therein the lubricants shown in Table 1 below, are shown in the attached FIGS. 1 and 2.

Table 1 Lubricants

Lubricants of the invention—Lubricants B and F
Comparative lubricant—Commercial grease A (corresponding to Standard MIC-152A of Ford Motor Co.)
Comparative lubricant—Commercial grease B (LIPANOC DX #2, a tradename for a product of Nippon Oil Co., Ltd.)

It is seen from the attached FIG. 1 that when the lubricants of this invention are used, both the oscillating torque and the rotating torque show a drastic decrease in static torque values as compared with the case of using the conventional lubricants, and their variations are markedly reduced, and that the difference between the static torque values and the dynamic torque values is very small.

This shows that the lubricants of this invention are much better than conventional greases, such as commercial grease A and lithium-type greases.

When the lubricant of this invention was used, not only could the torque value be maintained at a low value, but also in respect of the dynamic torque, the rotating torque could be made higher than the oscillating torque. Accordingly, this brings about attendant effects. For example, when the lubricant of this invention is used in an automobile suspension mechanism, the shimmy phenomenon believed to be due to the deflection of tires during driving can be inhibited.

EXAMPLE 3

Lubricants C and D and commercial lubricant B were each sealed into a ball joint consisting of a steel ball stud (with a spherical head portion having a diameter of 36 mm) and a ball seat made of polyacetal (OILES #80, a tradename for a product made by Oiles Industry Co., Ltd.), and the ball joint was subjected to a durability test.

The condition for the durability test are tabulated below.

Testing conditions

1. Load
   Ball stud axial direction ±450 kg, 40 cpm
Radial direction ±900 kg, 60 cpm
2. Ball stud
   Oscillation ±30°, 50 cpm
   Rotation ±30°, 60 cpm The test results are shown in FIG. 3 in terms of the durability versus varying amounts of stud end play.

The amount of stud end play denotes the amount of movement of the ball stud relative to the housing, which is measured with the housing kept fixed and a predetermined load exerted statically on the ball stud in a predetermined direction. In the present test, it denotes the amount of the end play of the stud which was measured when a pull-out load of 450 kg was applied to the ball stud in the axial direction of the housing.

It is seen from FIG. 3 that when the lubricants of this invention were sealed into the ball joint, it showed a marked increase in durability over the ball joint into which the conventional Li soap grease was sealed, in other words, this means that when it is desired to obtain a certain torque, the internal stress of a plastic ball seat can be increased by increasing the clamping space for the ball seat, and consequently, the durability of the ball joint increases.

The diamide compound (6) used in the above Example is for the purpose of thickening the imide compound (5), and is mixed in an amount in the range of 0 to 30% by weight (exclusive). The imide compound (1) obtained by the reaction of maleic anhydride with beef tallow amine is usually a liquid one. But to meet the requirements of ball joint lubricants, for example to prevent leakage at high temperatures or high pressures, it is desirably in the form of grease. When it is desired to thicken the compound (1), thickening may be achieved by partially hydrogenating the carbon-carbon double bond usually present in the hydrocarbon radical of beef tallow amine. If this is not sufficient, the above diamide compound (6) is incorporated to provide the desired consistency.

Although the above lubricant can be used for various kinds of ball joints, it is preferably a lubricant suitable for a ball joint constructed of a metallic ball stud and a plastic ball seat. The plastic material forming the ball seat need not always be a flexible resin when the lubricant of this invention is used. It may be selected from a wide range of synthetic resins such as fluorine-containing resins, polyolefin resins (e.g., polyethylene) and polyacetal resins.

EXAMPLE 4

Molten maleic anhydride (65.3 g) and 280 g of oleylamine were put into a 500 ml beaker equipped with a stirrer, and heated at 150° C. for 1 hour while stirring. After the reaction, the reaction mixture was allowed to cool to room temperature to give 240 g of a yellow viscous substance containing the imide compound of formula (2) as a main component.

In the presence of the resulting imide compound, the coefficient of friction between a steel ball (SUJ-2, 3 mm $\phi$) and a thin sheet (13 mm thick) of polyacetal and between the steel ball and a thin sheet (3 mm thick) of polypropylene was measured by the Bawden-Leben friction tester under a load of 2 kg and at a sliding speed of 3.6 mm/sec. The coefficient friction was 0.030 in the case of using the polyacetal seat and 0.01 in the case of using the polypropylene seat. On the other hand, the coefficient of friction measured between a polyacetal ball (3 mm $\phi$) and a thin sheet of polyacetal was 0.040.

EXAMPLE 5

The imide compound of formula (4) was obtained in an amount of 340 g in the same way as in Example 4 except that 121 g of phthalic anhydride and 228 g of oleylamine were used.

Using the resulting imide compound, the coefficient of friction between a steel ball and a thin sheet of polyacetal or polypropylene was measured in the same way as in Example 1. It was found to be 0.035, and 0.025, respectively.

EXAMPLE 6

The imide compound of formula (3) was obtained in an amount of 240 g in the same way as in Example 1 except that 114 g of glutaric anhydride and 129 g of 2-ethylhexylamine were used. Using the resulting compound, the coefficient of friction between a steel ball and a sheet of polyacetal or polypropylene was measured in the same way as in Example 4. It was found to be 0.040 and 0.028, respectively.

EXAMPLE 7

The compound of formula (1) was obtained in an amount of 395 g in the same way as in Example 1 except that 100 g of succinic anhydride and 337 g of oleylamine were used.

Using the resulting imide compound, the coefficient of friction between a steel ball and a polyacetal seat or a polypropylene seat was measured in the same way as described in Example 4. It was found to be 0.037, and 0.026, respectively.

Comparative Example 1

Using a lubricating oil fraction obtained from Minas crude oil by hydrogenating purification, the coefficient of friction between a steel ball and a polyacetal seat or a polypropylene seat was measured in the same manner as in Example 4. It was found to be 0.057, and 0.035, respectively.

On the other hand, the coefficient of friction between a polyacetal ball and a thin sheet of polyacetal was found to be 0.060.

The data shown in the above Examples and the Comparative Example demonstrate that the lubricating oil composition containing the imide compound in accordance with this invention is very useful for a lubricating action between a non-ferrous material, particularly a plastic material, and iron.

What is claimed is:

1. A lubricant comprising a diamide derivative of the formula

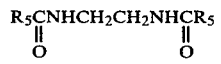

wherein $R_5$ represents a $C_{14}$–$C_{18}$ alkyl or alkenyl radical and a as a base lubricant an imide compound selected from the group consisting of imide compounds having the following formulas

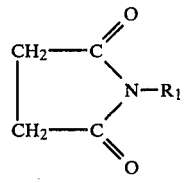

(1)

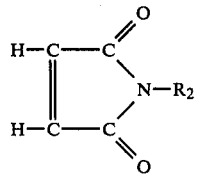

(2)

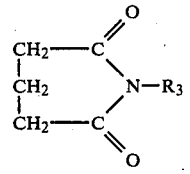

(3)

or

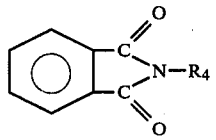

(4)

wherein $R_1$, $R_2$, $R_3$ and $R_4$ represent a $C_8$–$C_{18}$ saturated or unsaturated hydrocarbon radical, said imide compound being obtained by the reaction of a dibasic acid selected from the group consisting of succinic acid, maleic acid, glutaric acid and phthalic acid or the anhydride thereof with at least one primary amine having a corresponding $C_8$–$C_{18}$ hydrocarbon radical at 100° to 180° C. under atmospheric pressure in a mole ratio of the dibasic acid to the primary amine of from 1:1 to 1:less than 2.

2. The lubricant according to claim 1 wherein said diamide derivative is present in an amount of up to 30% by weight.

3. A method for preparing lubricants characterized by the step of using as an oil base thereof an acid imide compound of the formula (1)

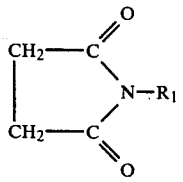

(2)

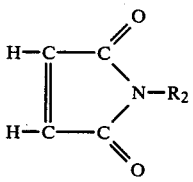

-continued (3)

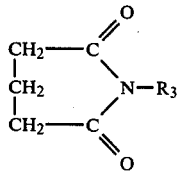

or (4)

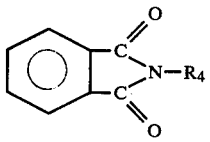

wherein $R_1$, $R_2$, $R_3$ and $R_4$ represent a $C_8$–$C_{18}$ saturated or unsaturated hydrocarbon radical, said imide compound being obtained by the reaction of a dibasic acid selected from the group consisting of succinic acid, maleic acid, glutaric acid and phthalic acid or the anhydride thereof with at least one primary amine having a corresponding $C_8$–$C_{18}$ hydrocarbon radical at 100° to 180° C. under atmospheric pressure in a mole ratio of the dibasic acid to the primary amine of from 1:1 to 1 to 1: less than 2.

* * * * *